United States Patent [19]

Peak

[11] 3,991,682

[45] Nov. 16, 1976

[54] CANISTER CARTRIDGE AND PROJECTILE ASSEMBLY WITH RELEASABLE NOSE

[75] Inventor: Vaughn E. Peak, Fullerton, Calif.

[73] Assignee: The United States of America as represented by the Secretary of the Army, Washington, D.C.

[22] Filed: Sept. 26, 1975

[21] Appl. No.: 617,207

[52] U.S. Cl. ..... 102/38; 102/92.1; 102/93

[51] Int. Cl.[2] ..... F42B 5/02

[58] Field of Search ..... 102/38, 34.4, 35.6, 102/37.6, 93, 91, 42, 92.1–92.7, 43

[56] References Cited

UNITED STATES PATENTS

| | | | |
|---|---|---|---|
| 2,983,224 | 5/1961 | Prosen et al. | 102/93 |
| 3,146,713 | 9/1964 | Sawyer | 102/42 R |
| 3,334,588 | 8/1967 | Larsen | 102/93 |
| 3,568,603 | 3/1971 | Vartanian | 102/91 |
| 3,765,297 | 10/1973 | Skochko | 102/43 R X |
| 3,771,455 | 11/1973 | Haas | 102/34.4 |
| 3,802,345 | 4/1974 | La Costa | 102/93 |

*Primary Examiner*—Harold Tudor
*Attorney, Agent, or Firm*—Nathan Edelberg; A. Victor Erkkila; Max Yarmovsky

[57] ABSTRACT

A canister cartridge projectile utilizes gun gas pressure, bled from the rear of a projectile through flow control orifices in a sabot body to a piston contained therein, and set-back acceleration to sequentially eject a payload and a nose cone assembly. The nose cone assembly is attached to the sabot by a plurality of detent lugs which are unlocked on setback by the movement of a slidable ring. Two O-ring seals positioned between the sabot and the nose assembly and the sabot and the cartridge assembly provide moisture protection for the projectile interior and the cartridge propellant charge.

5 Claims, 4 Drawing Figures

CANISTER CARTRIDGE AND PROJECTILE ASSEMBLY WITH RELEASABLE NOSE

GOVERNMENTAL INTEREST

The invention described herein was made in the course of a contract with the Government and may be manufactured, used and licensed by or for the Government for governmental purposes without the payment to me of any royalty thereon.

BACKGROUND OF THE INVENTION

Various means have been used in the prior art to counter ambush attacks against military personnel. In short range combat situations, such as found in the jungle and heavily treed areas, it is important that a high volume of firepower be available in order to assure combat success. In the past the individual soldier or patrol group caught in an ambush situation generally had only a limited ability to return high volume firepower. Standard infantry weapons using conventional munitions are inadequate to provide the necessary firepower and high volume firepower from automatic grenade launchers have problems with barrel rifling erosion. Those prior art munitions which utilized a shotgun type shell and payload were generally limited in down range effectiveness on a target because of the shot dispersion.

SUMMARY OF THE INVENTION

The present invention relates to a cannister type cartridge which is capable of being fired from an automatic grenade launcher weapon system or hand held weapon without causing barrel rifling erosion. An internal pressurization principle is utilized to maintain the outside envelope of the projectile sabot for feeding and firing through the weapon. A canister cartridge and projectile assembly are adapted after being fired from a weapon barrel to sequentially separate, to eject and propel the projectile nose cone ahead of the projectile body, and to eject and propel a shot payload from the projectile body behind the nose cone, all by gas pressure generated upon ignition of a cartridge propellant charge. The projectile comprises a hollow sabot having an open forward end which is enclosed by a hollow nose cone releasably mounted thereto. A slidable piston is enclosed within the sabot adjacent its aft end. The payload is positioned intermediate the piston and the nose cone assembly. The piston has passages therethrough which communicate with an annular gas space connected to the cartridge interior by corresponding passages in the rear end of the sabot. The gas passages in the sabot rear end direct gas pressure against the payload, positioned in abutting relationship thereto, of sufficient force to propel the payload forwardly out of and ahead of the sabot as the projectile emerges from the weapon muzzle. Gas pressure directed through the sabot and piston passages bleeds forwardly around the payload and into the hollow interior of the nose cone. The nose cone is provided with a ring type inertial releasing means which is actuated upon acceleration of the projectile through the weapon barrel. The ring releasing means frees the nose cone from the sabot and then the gas pressure therein propels the nose cone ahead of the sabot. The payload is ejected therefrom upon subsequent deceleration which occurs after emergence of the projectile components from the weapon muzzle.

An object of the present invention is to provide a canister cartridge and projectile assembly with releasable nose cone which is designed for use in automatic grenade launchers.

Another object of the present invention is to provide a canister cartridge and projectile assembly with releasable nose cone which can be fired from an automatic grenade launcher weapon system without causing significant barrel rifling erosion.

A further object of the present invention is to provide a canister cartridge and projectile assembly with releasable nose cone which gives good shot pattern control and has improved down range effectiveness on a target.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
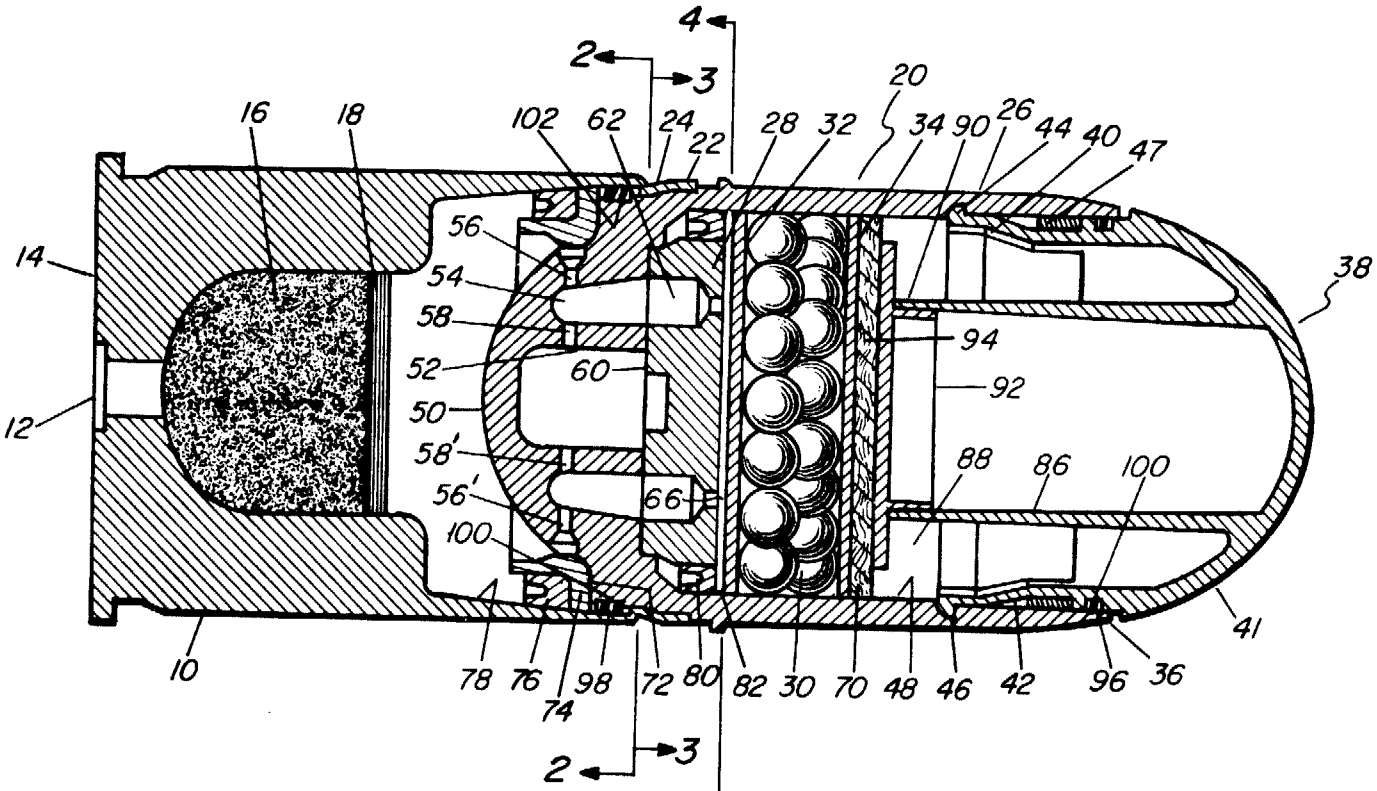
FIG. 1 is a diametral longitudinal cross-sectional view of the canister cartridge projectile assembly.

Referring now to FIG. 1 a cup shaped canister cartridge member 10, made of such material as aluminum, has a standard breech-mounted percussion type primer 12 axially disposed in the cartridge partially closed rear end 14 and a propellant charge 16 axially abutting the primer 12 and retained therein behind a circular cardboard wad 18. A projectile assembly 20 is retained in the open forward end 22 of cartridge member 10 by circumferential hydroform crimps or stakes 24. The projectile assembly 20 includes a hollow body or sabot member 26, preferably fabricated of a high strength-to-weight plastic material such as glass-filled nylon, for example, a piston member 28 which is also fabricated of plastic glass-filled nylon material, a payload 30 consisting, in one preferred embodiment, of a plurality of metal shot or balls made of such material as tungsten, and a first disc shaped plate member 32 and a second plate member 34, each made of a material such as aluminum. The plates 32 and 34 are slidably disposed in the hollow tubular section of the sabot 26 on both sides of the payload 30. First disc plate 32 is disposed intermediate the piston 28 and the payload 30.

The open forward end 36 of the sabot 26 is enclosed by a hollow nose cone assembly 38, preferably made of a similar resilient plastic material as aforedescribed for the sabot 26. The nose cone is releasably mounted and secured to the sabot 26 by a plurality of spaced-apart, flexible, integral elongated levers or lugs 40 which extend from the nose cone ogive 41 and which are shaped with angularly outwardly extending caming surfaces 42 disposed opposite the adjacent interior wall of the sabot 26. The locking levers 40 each terminate in outwardly projecting tabs or pawls 44 that are normally retained in a circumferential sabot pawl groove 46 located around the interior wall 48 of the forward end of sabot 26.

A set-back ring 47, preferably molded of rigid plastic, encircles the exterior surface of locking levers 40, and is disposed forwardly of the caming surfaces 42. The set-back ring 47 functions when the set-back acceleration force, generated as the projectile assembly 20 is propelled forwardly through a weapon barrel (not shown), causes it to slide rearwardly around the locking levers 40 and over the caming surfaces 42. The ring 48 urges the levers or lugs 40 radially inwardly and retract the pawls 44 from groove 46 thereby releasing the nose cone 38 for subsequent separation from the sabot 26.

Figures 2, 3, 4:
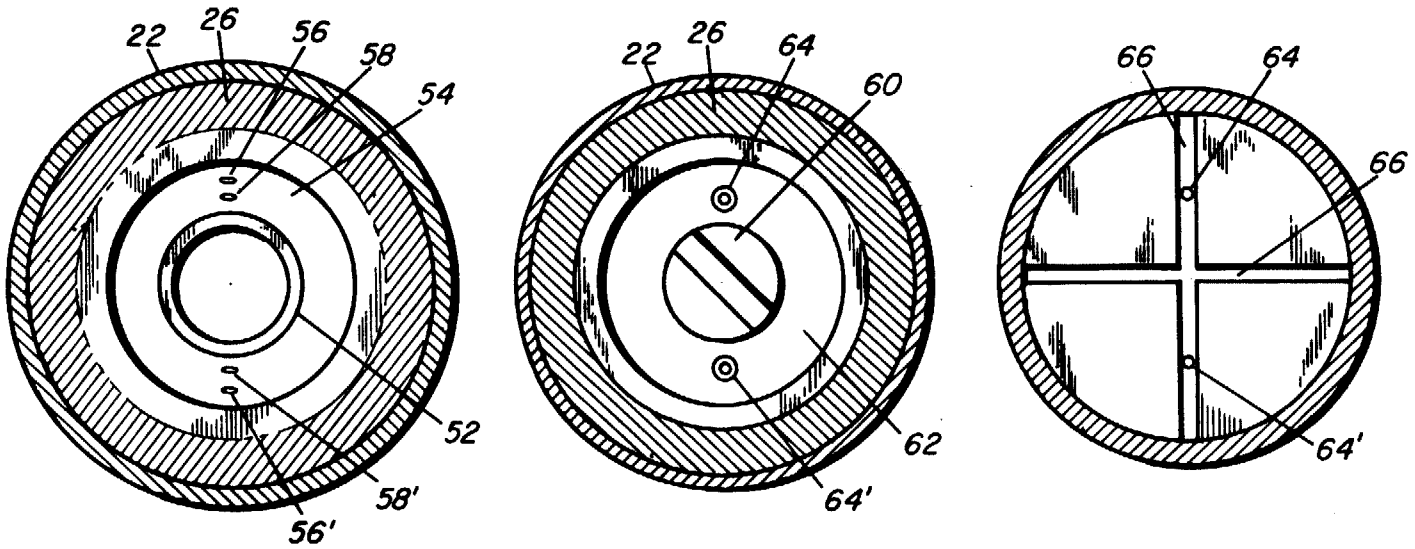
FIG. 2 is a view of the aft end of the sabot taken along line 2—2 of FIG. 1.
FIG. 3 is a view of the rear end of the piston taken along line 3—3 of FIG. 1.
FIG. 4 is a view of the forward end of the piston taken along line 4—4 of FIG. 1.

Referring now to FIGS. 1–3 sabot cup shaped partially closed rear end 50 has an open-ended tube 52 centrally disposed therein. An annular gas cavity 54 is axially aligned around tube 52. A first pair of flow passages 56 and 56' extending through the rear wall 50 of sabot 26 direct gas pressure generated upon ignition of the propellant 16 into the annular gas cavity 54. A second pair of flow passages 58 and 58', provided through the wall of sabot tube 52, permit gas pressure from the annular space 54 to fill the interior of tube 52 and to exert uniform pressure against the rear side 60 of piston 28 which abuts the open end of tube 52. Piston 28, as shown in FIGS. 1 and 3, is provided with an enlarged concentric channel 62 in its rear side 60 which is aligned and communicates with sabot annular gas cavity 54, and piston gas flow passages 64 and 64' which direct gas pressure from the sabot annular gas cavity 54 forwardly against the rear side of plate 32. The aluminum metal disc 32 is positioned intermediate the forward side of piston 28 and the rear side of payload 30 to prevent deformation of the piston 28 by the payload 30 during the acceleration sequence.

Referring now to FIGS. 1 and 4, the forward side of piston 28 adjacent to plate 32, is provided with several radially extending grooves 66 leading from the openings of piston gas flow passages 64 and 64' to direct gas pressure radially outwardly, there being sufficient clearance between the payload 30, the discs 32 and 34 and the inner wall 48 of the sabot 26 to permit gas pressure to flow forwardly in between payload balls 30 and into the nose cone assembly annular space 88.

The rear end 50 of the sabot 26 is formed with a circumferential flange or shoulder 72 to retain a free fitting, rigid, plastic adaptor ring 74 which backs up a flexible rubber chevron shaped seal or obturator 76. The obturator 76 expands outwardly, upon generation of gas pressure when the propellant 16 is ignited, and presses tightly against the interior wall 78 of the cartridge 10 to prevent leakage of gas therefrom. Since the adaptor ring 74 is free fitting, it will not induce excessive spin forces on the projectile 20 as it is propelled through the weapon rifled barrel.

To prevent gas leakage between the sabot annular gas cavity 54 and the piston 28, a second chevron rubber seal or obturator 80 is provided on a circumferential flange or shoulder 82 formed around the periphery of piston 28.

Extending rearwardly from the tip of nose cone ogive member 41, and integrally molded therein, is an internal tube 86 which extends rearwardly from the tip of the ogive and is concentrically positioned therein. The tube 86 has an exterior annular space 88 therein, similar to the sabot annular gas cavity 54 aforedescribed. The open end 90 of nose cone internal tube 86 is closed by a flanged cap 92 whose primary purpose is to reduce the volume of space in nose cone 41. The excess space between the closure flanged cap 92 and the second aluminum metal disc or plate 34 is filled by a circular spacer pad 94, made of a foam plastic material such as polyurethane. Pad 94 maintains the internal projectile components in compact relationship with each other.

First and second "O" rings 96 and 98 are mounted in annular "O" ring grooves 100 and 102 respectively. The "O" rings 96 and 98 provide a moisture tight seal between the cartridge 10 and the projectile 20 and between sabot 26 and nose cone 41, thus insuring against moisture intrusion.

In operation, when propellant 16 is ignited by impact primer 12, the resultant gas generated flows through the first pair of flow passages 56 and 56' into the sabot annular gas cavity 54 and through the second pair of flow passages 58 and 58' respectively into tube 52; the gas exerting a propelling force against the rear side 60 of piston 28. Simultaneously, the gas in annular gas cavity 54 flows into piston channel 62 and through piston gas flow passages 64 and 64'. Gas also flows along piston radial grooves 66 and in between payload balls 30 and between the interior wall 48 of sabot 26 and into the annular space 88 in nose cone 41 to propel the nose cone 41 forwardly ahead of the sabot 26 after action of the setback ring 47.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described the invention what is claimed as new and desired to be secured by Letters Patent of the United States is:

1. A canister cartridge which comprises:

a cup shaped cartridge member having a partially closed rear end and an open forward end;

a primer axially disposed in the rear end of said cartridge member;

charge means, for generating gas pressure which includes;

a propellant axially disposed in said cartridge member and aligned with said primer and in contact therewith; and a circular cardboard wad transversely positioned within said cartridge member, said wad holding said propellant in said rear end of said cartridge member;

sabot means, releasably disposed in the forward end of said cartridge member, for holding therein and dispensing therefrom a payload which includes;

a hollow body member having a cup shaped partially closed rear end and a forward open end, said rear end having an exteriorally formed circumferential shoulder thereon and a molded open ended tube centrally disposed therein, said body member having an annular gas cavity axially aligned with and exterior to said open ended tube, said rear end having a first pair of flow passages extending through the rear wall of said rear end, said first pair of passages communicating with said annular gas cavity, a second pair of flow passages passing through said open ended tube which communicate with the interior of said open-ended tube, a circumferentially disposed sabot "O" ring groove positioned in the exterior wall of said sabot rear end, and a circumferential sabot pawl groove positioned in the interior wall of the forward end of said body member;

piston means for controlling therethrough the flow of gas generated by said charge means and for expelling said payload from said sabot means which includes;

a piston member having a rear side and a forward side, a circumferential shoulder disposed around the periphery of said piston member, said rear side being provided with an enlarged concentric channel aligned and communicating with said annular gas cavity of said body member, said forward side having a plurality of radially extending grooves therein, a pair of piston gas flow passages transversely disposed in said piston member intermediate said forward side and said enlarged concentric channel permit gas generated from said propellant to flow from said enlarged concentric channel to said forward side of said piston member;

a first disc shaped member positioned in said body member which abuts against said forward side of said piston member;

a plurality of metal shot disposed in said body member, said shot abutting against said first disc member;

a second disc shaped member positioned in said body member so that it abuts against said plurality of metal short, said second disc holding said metal shot intermediate said first and second disc members;

a disc shaped flexible pad positioned in said body member intermediate said second disc shaped member and said nose cone means;

a free fitting rigid plastic adaptor ring operatively positioned on said formed circumferential shoulder of the rear end of said body member;

a first rubber chevron shaped obturator positioned intermediate said adaptor ring and the interior wall of said cup shaped cartridge member;

a second chevron shaped rubber obturator positioned in said piston shoulder; and an "O" ring seal operatively positioned in said sabot "O" ring groove intermediate the exterior wall of said body member and the interior wall of said cartridge member; and releasable nose cone means for providing moisture protection for the interior of said sabot means and for said charge means, and means for sequentially releasing said nose cone means from said sabot means after set-back acceleration so that said nose cone means can move forwardly away from said sabot means.

2. A canister cartridge as recited in claim 1 wherein said nose cone means comprises:

a hollow ogive member having an integrally molded internal tube protruding rearwardly from the tip of said ogive, and a plurality of flexible integral locking levers which have caming surfaces disposed thereon, which terminate in outwardly projecting pawls which are normally retained in said sabot pawl groove;

a flanged cap fixedly attached to the open end of the internal tube of said ogive; and said means for sequentially releasing said nose cone means includes a set-back ring encircles the exterior surface of said locking levers, said ring being disposed forwardly of said caming surfaces, wherein said set-back ring under a set-back acceleration force slides rearwardly around said locking levers over said caming surfaces urging said levers radially inward, thereby retracting said pawls from said sabot pawl groove and releasing said ogive member for separation from said sabot means.

3. A canister cartridge as recited in claim 1 wherein said hollow body member is made of a high strength-to-weight plastic material such as glass-filled nylon.

4. A canister cartridge as recited in claim 1 wherein said metal shot is made of tungsten material.

5. A canister cartridge as recited in claim 2 wherein said ogive member is made of such material as glass-filled nylon.

* * * * *